United States Patent [19]

O'Brien et al.

[11] Patent Number: 4,615,487

[45] Date of Patent: Oct. 7, 1986

[54] HYDROCANNON SYSTEM FOR CLEANING POWER PLANTS

[75] Inventors: Errol C. O'Brien, Palos Park; Martin Placko, Chicago; Wayne Breneman, Cole City, all of Ill.

[73] Assignee: J-B Industrial Corp., Worth, Ill.

[21] Appl. No.: 600,439

[22] Filed: Apr. 16, 1984

[51] Int. Cl.[4] ..... B05B 15/08

[52] U.S. Cl. ..... 239/281

[58] Field of Search ..... 239/587, 280, 281, 286, 239/184, 280.5; 169/52, 24, 25; 74/493; 403/104, 164, 165; 285/302; 182/36

[56] References Cited

U.S. PATENT DOCUMENTS

| | | | |
|---|---|---|---|
| 2,465,562 | 3/1949 | Hopper et al. | 239/184 |
| 2,598,780 | 6/1952 | Garnier | 403/166 |
| 2,787,485 | 4/1957 | Frisell | 403/104 |
| 2,857,201 | 10/1958 | Palmer | 239/587 |
| 3,061,201 | 10/1962 | Rienecker | 239/281 |
| 3,440,096 | 4/1969 | Scott . | |
| 3,477,178 | 11/1969 | Hulbert, Jr. . | |
| 3,830,430 | 8/1974 | Hartunian . | |
| 3,836,084 | 9/1974 | Luke . | |
| 3,847,753 | 11/1974 | Baird et al. . | |
| 4,106,516 | 8/1978 | Wiegand . | |

*Primary Examiner*—Jeffrey V. Nase
*Assistant Examiner*—Scott Malpede
*Attorney, Agent, or Firm*—Edward D. Gilhooly

[57] ABSTRACT

A hydrocannon system for removing deposits from surfaces, such as in the cyclone burner of an electrical generating station. A high pressure spray of water is propelled through the nozzle of a gun at high pressure to hydroblast material to be cleaned from the surface. The gun is self supported on a rack for adjustable vertical movement, up and down tilting movement, and swinging movement about an axis for a 360° arc.

12 Claims, 4 Drawing Figures

12
104
100
90
106
108
110
96
10

82a
84a
86
84
4
90
94
82
66
68
62
92
4
64
76
72
74
70
8
60
24
50
40
6
50
32
34
42
44
42
48
46
48
30

HYDROCANNON SYSTEM FOR CLEANING POWER PLANTS

BACKGROUND OF THE INVENTION

This invention relates in general to a spray cleaning apparatus and, in particular, to a hydrocannon system for removing deposits from surfaces.

More specifically, but without restriction to the particular use which is shown and described, this invention relates to a hydrocannon cleaning system for removing deposits from the surfaces of installations, such as in a coal burning electrical power plant. The system of the invention anchors an ultra-high pressure water cleaning device for movable positioning adjacent the surface to be cleaned for increased efficiency of operation. The gun and nozzle of the invention may be vertically adjusted, swung in an arc of 360° and tilted either downward or upward during a cleaning operation. The gun and nozzle mount herein disclosed is supported for movement adjacent the surface as required during a cleaning operation.

As is well known, many electrical generating stations use fossil fuel as the energy source for producing electricity. As a result of the operation of a fossil fuel plant, a buildup of foreign material occurs on the walls of the power plant, such as in the cyclone burner. This accumulation of material on the walls of the equipment may adversely affect the efficiency of electrical generation and cause damage to the installation. It is common practice therefore to shut down operation of the station on a periodic basis and clean the various internal parts as needed.

The internal buildup of material may include deposits, such as fly ash, slag, refractories, and the like. In the past, one common technique for removing material from the walls of structure in an electrical generating station has been by applying water at ultrahigh pressures to dislodge the deposits from the surface. One well-known water cleaning system of the high pressure type propels a water stream through a nozzle at pressures of 10,000 psi or greater. The use of pressurized water is a particularly good technique of removing deposits, since chemicals, fumes, hand tools, and other disadvantageous problems are eliminated.

In the past, the high pressure water is delivered to a nozzle of a gun that is manually held by an operator during the cleaning process. The gun of such systems is generally propped against the shoulder, to counteract the reaction forces of the high pressure jet of water. This subjects the user to a considerable force while aiming the nozzle propelling water at pressures of 10,000 and more psi for a day long shift. The fatigue factor for such jobs using prior equipment increases the number of man-hours required for any given cleaning task at an electrical power plant. Accordingly, hand-held water blasting, as is the common technique in the industry, is physically straining and relatively inefficient.

SUMMARY OF THE INVENTION

It is therefore an object of this invention to provide an improved water cannon system.

Another object of this invention is to provide a self-supporting water cannon system delivering a high pressure water stream to the surface to be cleaned.

A further object of this invention is to provide a water cannon system arranged for selected vertical adjustment.

Still another object of this invention is to provide an improved water cannon system having means to support the nozzle gun thereof for movement in a 360° arc about an axis.

A still further object of this invention is to provide a water cannon capable of being aimed in any selected position.

Still another object of this invention is to provide a water cannon system capable of increased efficiency in cleaning material from the walls of an installation.

These and other objects are attained in accordance with the present invention wherein there is provided an improved water cannon system for delivering a high pressure stream of water against material adhering to a surface of an installation, such as in the burner and other parts of a coal burning, electrical generating station. The water cannon of the invention is mounted on a movable platform to situate the nozzle at an appropriate position during a cleaning task. The invention of the application includes means to mount the nozzle of the delivery hose in a manner to relieve the operator from the physical strain caused by the reaction forces during spraying. The nozzle of the invention may be aimed in any selected direction and may be separately adjusted in a vertical direction to a fixed position for accomplishing a cleaning action as desired. In addition, the operator may swing the nozzle through an arc of up to 360° to apply the spray of water to the surface in a manner which is best and most efficient.

The invention of the application greatly improves the cleaning of slag, fly ash, refractories, and the like, from any type of equipment, such as in an electrical generation station. In electrical power plants, the necessity to shut down operations for cleaning is a very expensive proposition. The water cannon system herein disclosed allows a cleaning task to be done in significantly less time and with fewer men than prior art hand-held techniques. The system of the application dramatically reduces the physical strain on the operator to accomplish a job in a manner that increased efficiency and speed of cleaning is attained. The hydrocannon system of the invention is capable of delivering 10,000 or more psi of water pressure to a surface for cleaning in any direction and with freedom of manueverability and manipulation without requiring the operator to use his body and his shoulder to counteract the reaction forces of the spray. The operator can easily adjust to move the lance in a 360° arc forward and back in a cyclone burner and the like of a power plant or any other type installation by which his efficiency is significantly increased.

DESCRIPTION OF THE DRAWINGS

Further objects of the invention, together with additional features contributing thereto and accruing therefrom, will be apparent from the following description of a preferred embodiment of the invention which is shown in the accompanying drawings with like reference numerals indicating corresponding parts throughout, wherein.

DESCRIPTION OF THE PREFERRED EMBODIMENT

Figure 1:
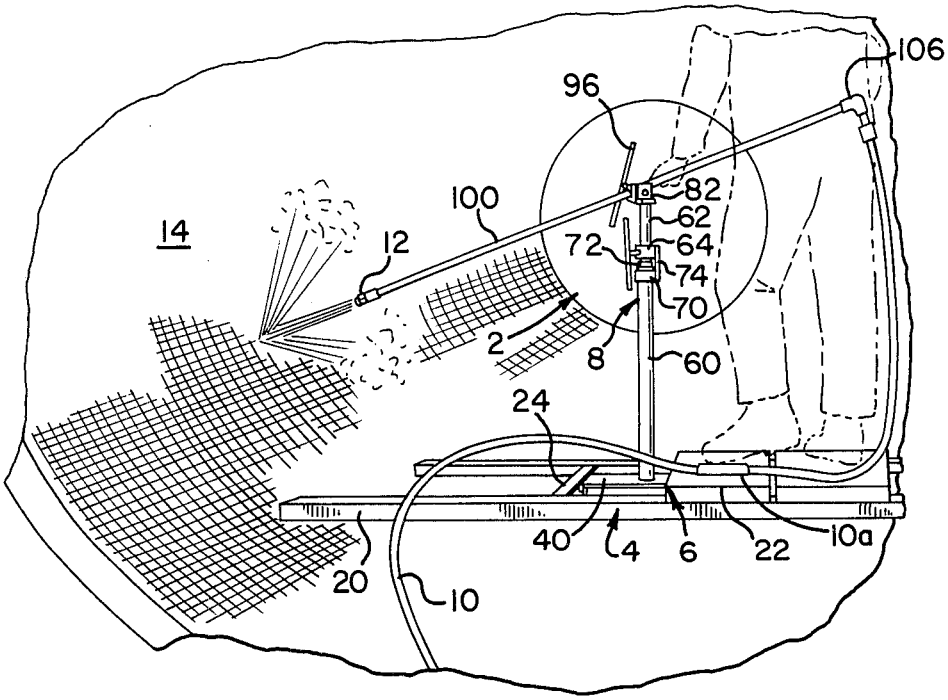
FIG. 1 is a perspective side view of the water cannon system of the invention in operative position.

Referring now to FIG. 1, there is illustrated the hydrocannon system of the invention for cleaning surfaces, as shown in operative position within an installation, such as in a cyclone burner or other components of an electrical generating station powered by coal. In such power plants, the internal buildup of slag, fly ash, refractories, and the like, must be removed for the satisfactory operation of the station. Although the invention is described with reference to cleaning coal burning power plants, it is within the scope of the invention to use the invention to clean other surfaces where high pressure liquid streams are required to dislodge adhering material. Generally, high pressure water is used in conjunction with the invention herein disclosed, although other liquids may be propelled through the nozzle.

In FIG. 1, the hydrocannon system of the invention is generally designated by the reference numeral 2. Water cannon system 2 essentially includes a pair of support frame members 4, a carriage assembly 6 upon which an upright support assembly in the form of a stand 8 is situated. High pressure water is supplied to the water cannon system 2 by means of a conventional hose 10 capable of delivering a pressure of 10,000 psi or more to a nozzle 12 from suitable pumping apparatus (not shown). The high pressure cleaning system used in conjunction with the water cannon system 2 may comprise any commercially available unit, such as the Partek Liqua-blaster, manufactured by the Partek Corporation.

Figure 2:
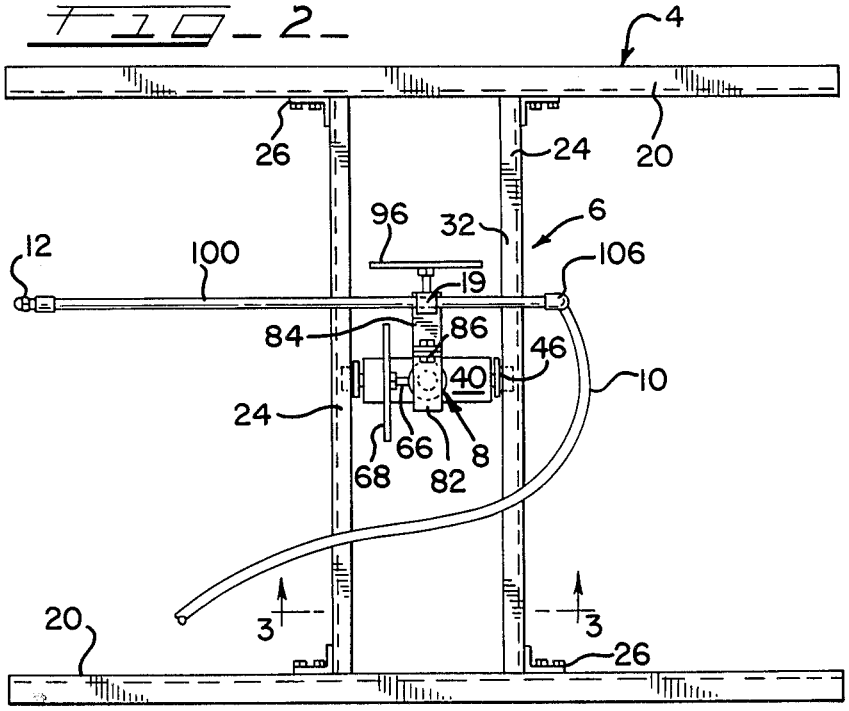
FIG. 2 is a top schematic view of the water cannon system of FIG. 1.

As seen in FIGS. 1 and 2, the frame 4 includes a pair of support beams 20 of a selected length capable of suspending the carriage assembly 6 in an elevated position within the installation being cleaned. In addition, the beams 20 may include removable panels or other structure upon which the operator may stand during a cleaning operation, as shown in FIG. 1. The operator may control the stream of water pressure from nozzle 12 through operation of a conventional foot pedal 10*a*, which also may be situated upon the removable panel 22. A portion of the ends of each of the beams 20 is arranged to contact a surface which is curved, such as shown in FIG. 1, or may lay flat or elevated on other support means where other shaped support surfaces are encountered.

As shown in FIG. 2, the carriage assembly 6 is arranged to extend laterally between the space beams 20, and includes a pair of rails 24 having respective ends retained on the beams 20 by means of threaded brackets 26 or other attachment means. The rails 24 are formed by an elongated member 30 having an angle section and being welded or otherwise affixed to a plate 32 to form inwardly facing U-shaped channels 34 extending between the two beams 20.

Figures 3, 4:
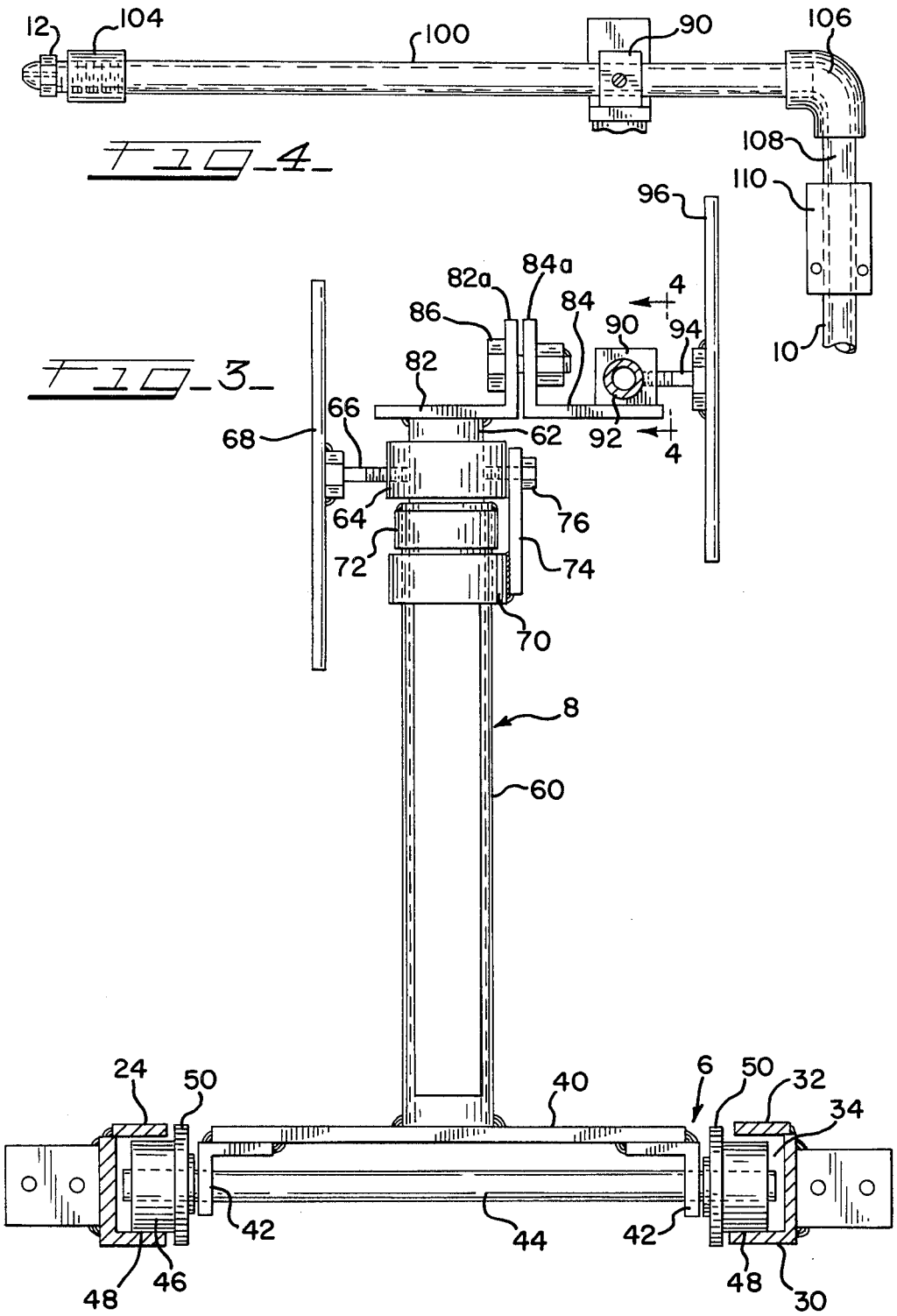
FIG. 3 is a side schematic view of the water cannon system of FIG. 2.
FIG. 4 is a side schematic view of the fluid conduit assembly of the water cannon system of FIG. 2.

The carriage assembly further includes a platform or base 40 which is mounted and suspended for movement within channels 34 along the track members 24 as desired. The base 40 includes a pair of downward extending angle members 42 which are affixed by welding and the like to the underside of the platform 40 to form downward projecting skirts on each side of the platform 40. A pair of elongated shafts extend beneath the platform 40 and have end portions 44*a* which extend beyond the skirt portions of members 42. Suitable wheels 46 are journaled for rotary movement on shaft 44 and include a lower contacting surface 48 to ride along the bottom of channel 34. The wheels 46 further include an enlarged inner portion 50, as seen in FIG. 3.

An upright shaft in the form of a tubular upright member 60 of the support assembly 8 is affixed to the upper surface of carriage platform 40. The upper open end of the hollow tubular member 60 is provided with an upper member 62 in the form of an inner telescopic rod which may be selectively movable with respect to the tubular member 60. A collar 64 is situated adjacent the upper end of tubular member 60 for the selective adjustment of the height of the end of the telescopic member 62. The position of the member 62 may be locked in a fixed vertical position in relation to tubular member 60 through tightening of a threaded shaft 66, which extends through the collar 64. The end portion of the threaded shaft 66 is tightened against the member 62 through rotation of bar 68. By loosening the threaded member 66 through manipulation of bar 68, the inner member 62 is free to move upward or downward to adjust the height of its upper end for the convenience and efficiency of the operator. In its tightened, fixed vertical relationship, the collar 64 may move with respect to the tubular member 60 to an extent to permit both the inner member 62 and the collar 64 to rotate about a generally vertical axis through an arc of up to 360° in either direction of in an oscillating motion.

As added support of the telescoping members 60, 62, a pair of rings 70, 72 are positioned on the upper portion of the tubular member 60. The ring 72 is affixed at its upper edge by welding or the like to the tubular member 60. A metal strap or bar 74 is affixed at its lower end to the lower ring 70 and to a bolt 76 affixing the upper portion of the strap 74 to the collar 64. The ring 70 thus may rotate in conjunction with the collar 64, while the ring 72 acts as an anchoring support base for the ring 70 and the shaft 62.

A mounting plate 82 is welded or otherwise affixed to the upper end of telescopic member 62 and includes an integral flange 82*a* to carry a second plate 84 having a flange 84*a*. A bolt assembly 86 extends through the adjacent flanges 82*a*, 84*a* to connect plates 82 and 84 in a manner that the plate 84 can be pivotally moved about a horizontal axis created by the bolt assembly 86. The bolt assembly 86 may be tightened to allow freedom of pivotal movement or fix plate 84 at predetermined position relative to plate 82. Its pivotal movement on bolt assembly 86 allows the plate 84 to be tilted upward or downward to control the direction of the stream of water as needed by the operator. The upper surface of the plate 84 is provided with a block 90 through which a channel 92 is provided. A threaded shaft 94 extends through the block 90 into the channel 92 and may be manipulated by a rod or bar 96.

Referring now to FIG. 4, there is illustrated a tubular housing or conduit 100 which is directed through channel 92 in block 90 for retention on the system 2 of the invention. The tubular housing 100 includes an elongated conduit disposed in the channel 92. The conduit may be affixed within block 90 against relative movement therebetween through tightening of the threaded shaft 94, and released by loosening the threaded shaft 94 and sliding the conduit 100 to a selected position relative to block 90 to adjust the position of the nozzle 12 as is needed in operation. The outlet of the conduit includes a coupler element 104 upon which the nozzle 12 may be affixed. The inlet end of the conduit 100 is connected to an elbow 106, or similar connecting element, and a subsequent line 108 having a conventional coupler 110 thereon. The inlet end of the coupler 110 is designed to be connected to the outlet of the hose of an ultra-high pressure hydro cleaning system delivering pressured water through conduit 100 for discharge from nozzle 12 at pressures of 10,000 psi or more, as needed for cleaning.

From the foregoing, it should be apparent that the direction of the flow of water from nozzle 12 can be easily controlled by an operator, such as shown in FIG. 1, while the conduit 100 is fixed within the block 90, in a manner that the load and reaction forces on the operator are substantially reduced. The operator may tilt the direction of the nozzle 12 upward or downward, or in a horizontal direction through movement of plate 84 with respect to fixed plate 82. The height of the tubular housing in block 90 may be adjusted by moving the telescopic member 62 within the tubular member 60 to a selected height and by fixing that selected height. At its fixed vertical positioning, the platform created by plates 82 and 84 may be swung about the vertical axis of member 62 in an arc of 360° or less. In such a manner, the cleaning job can be accomplished while minimizing the strain on the operator and reducing the number of manhours necessary to accomplish a given cleaning task. The nozzle 12 and conduit 100 can easily be swung in an oscillating motion for effective results.

While the invetion has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A liquid cannon system for applying a high pressure stream against a surface to be cleaned comprising support means having a base and an upright member extending along a generally vertical axis and adhering to the upper surface of said base;

mounting means operatively connected to an upper portion of said upright member;

conduit means selectively affixed to said mounting means and having an inlet arranged to be connected to a hose delivering liquid under pressure and having an outlet arranged to be connected to a nozzle for discharging the liquid, said conduit means being affixed to said mounting means at a fixed position between said inlet and said outlet;

means for selectively moving said mounting means for a predetermined distance along said axis for adjusting the vertical position of said outlet;

means for locking said mounting means at a selected one of a plurality of fixed vertical positions at points extending along the extent of said distance along said axis said means for locking precluding any vertical movement of said mounting means; and said mounting means being mounted for free pivotal movement relative to said upright member for 360° about said axis and about a second axis perpendicular to said axis of said mounting means to alter the direction of the discharge of liquid from the nozzle.

2. The system according to claim 1 wherein the said second axis extends in a direction approximately perpendicular to the axis of said upright member for changing the horizontal inclination of the nozzle.

3. The system according to claim 1 wherein said mounting means includes an upper member mounted for relative movement relative to the axis of said upright member and a mounting plate affixed to said upper member.

4. The system according to claim 3 wherein said upper member and said mounting plate are mounted for free pivotal movement relative to the axis of said upright member.

5. The system according to claim 4 wherein said upright member is a hollow tube having an upper open end, said upper member having a lower portion disposed within said tubular member for rotational movement therein, said means for selectively moving said mounting means being operatively connected to said tubular member and said upper member for permitting relative movement of said tubular member and said upper member along said axis to adjust said vertical position.

6. The system according to claim 1 wherein said conduit means is mounted on a portion of said mounting means and including means mounting said portion on said mounting means for movement about an axis generally extending perpendicular to said axis of the upright member and perpendicular to the direction of discharge of said liquid.

7. The system according to claim 1 wherein said support means includes channel means for carrying said base for movement in opposite directions.

8. The system according to claim 1 wherein said mounting means includes means for selectively adjusting the position at which said conduit means is affixed to said mounting means.

9. A high pressure hydrocannon system comprising an upright shaft mounted on base means;

a member being carried on an upper portion of said shaft and having retention means for retaining a fluid conduit to said member;

first means mounting said member for pivotal movement about the vertical axis of said shaft for swinging said member in an arc;

second means for mounting said member for pivotal movement about an axis approximately perpendicular to the axis of said shaft;

adjustment means for selectively varying the height of said member relative to said shaft and fixing the member at a selected height while permitting said pivotal movement about said axes;

said upright shaft is a tubular member, said first means including an upper member being mounted within said tubular member;

said adjustment means includes a collar positioned about said upper member at a position above said tubular member;

means for selectively permitting axial movement of said collar relative to said upper member for vertical adjustment of said upper member; and means for preventing axial movement of said collar to establish a fixed vertical position of said upper member in said tubular member while permitting free relative rotational movement between said upper member and tubular member.

10. The system according to claim 9 wherein base means includes a pair of spaced channel members carrying a base mounting said shaft, means for permitting movement of said base along said channel members.

11. The system according to claim 9 further comprising a conduit having an inlet for coupling to a hose delivering a high pressure liquid to said conduit and an outlet for coupling to a nozzle for discharging the liquid, said retention means acting to retain said conduit on said member, and said retention means being releasable to permit relative movement between said conduit and said retention means.

12. A high pressure hydrocannon system comprising an upright shaft mounted on base means;

a member being carried on an upper portion of said shaft and having retention means for retaining a fluid conduit to said member;

said base means includes a pair of spaced beams and a pair of elongated transverse members affixed to said beams forming a pair of rails;

said elongated members being capable of being supported at an elevated position above a surface, a base being carried by said said base having wheels engaging said rails for selective movement therealong;

said movement along said rails acting to alter the horizontal position of said base of said upright shaft; and a platform supported by said beam members for supporting an operator.

* * * * *